United States Patent [19]

Hall

[11] Patent Number: 4,732,568

[45] Date of Patent: Mar. 22, 1988

[54] ELECTRICAL CONNECTOR WITH INTEGRAL GROUND STRAP FOR SHIELDED CABLE

[75] Inventor: Charles Hall, Roanoke, Va.

[73] Assignee: Virginia Plastics Company, Roanoke, Va.

[21] Appl. No.: 935,076

[22] Filed: Nov. 24, 1986

Related U.S. Application Data

[63] Continuation of Ser. No. 841,042, Mar. 17, 1986, abandoned, which is a continuation of Ser. No. 761,667, Aug. 1, 1985, abandoned, which is a continuation of Ser. No. 597,279, Apr. 6, 1984, abandoned.

[51] Int. Cl.[4] ..... H01R 13/648; H01R 23/02

[52] U.S. Cl. ..... 439/676; 439/607

[58] Field of Search ..... 339/14 R, 14 P, 99 R, 339/143 R, 176 M; 439/78, 607, 676

[56] References Cited

U.S. PATENT DOCUMENTS

| | | | |
|---|---|---|---|
| 3,015,794 | 1/1962 | Kishbaugh | 339/14 |
| 3,587,029 | 6/1971 | Knowles | 339/14 |
| 3,634,598 | 1/1972 | Stanfield | 174/51 |
| 3,825,874 | 7/1979 | Peverill | 339/14 R |
| 3,838,380 | 9/1979 | Stieler | 339/14 R |
| 4,039,235 | 8/1977 | Thibeault | 339/14 R |
| 4,210,376 | 7/1980 | Hughes et al. | 339/176 M X |
| 4,235,501 | 11/1980 | Ericsson | 339/191 M |
| 4,291,930 | 9/1981 | Landgreen | 339/14 P |
| 4,424,403 | 1/1984 | Bogese | 339/99 R X |
| 4,457,575 | 7/1984 | Davis et al. | 339/143 R |
| 4,537,459 | 8/1985 | Brennan et al. | 439/607 |
| 4,641,901 | 2/1987 | Brennan et al. | 439/607 X |

OTHER PUBLICATIONS

IBM Technical Disclosure Bulletin, vol. 23, No. 9, Feb. 1981, Uberbacher; Cable Connector with Integral Grounding Feature.

*Primary Examiner*—Eugene F. Desmond

*Attorney, Agent, or Firm*—Saidman, Sterne, Kessler & Goldstein

[57] ABSTRACT

An electrical connector incorporates a ground strap conductor that more efficiently grounds the shield of a multi-conductor shielded cable. The ground strap conductor at one end includes a spring contact portion which is indistinguishable structurally and functionally from the spring contact portions of the normal conductors of the connector. The other end of the ground strap conductor is of greatly increased surface area in order to provide a wide, short path to ground for the high frequency EMI and high voltage spikes. Several different embodiments for terminating the ground strap are disclosed, and the invention is particularly designed, although not limited to, use with telephone-type modular jacks and modular shielded cables terminated in telephone-type modular plugs.

26 Claims, 10 Drawing Figures

FIG. 2.
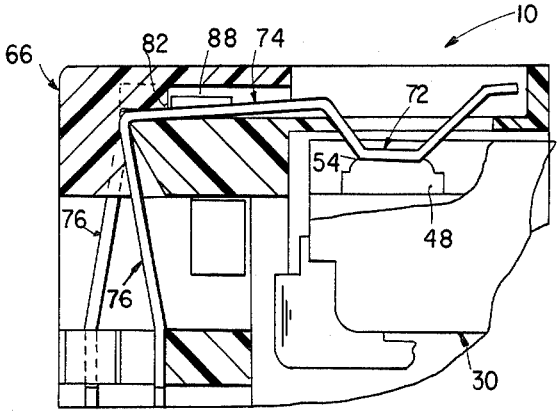
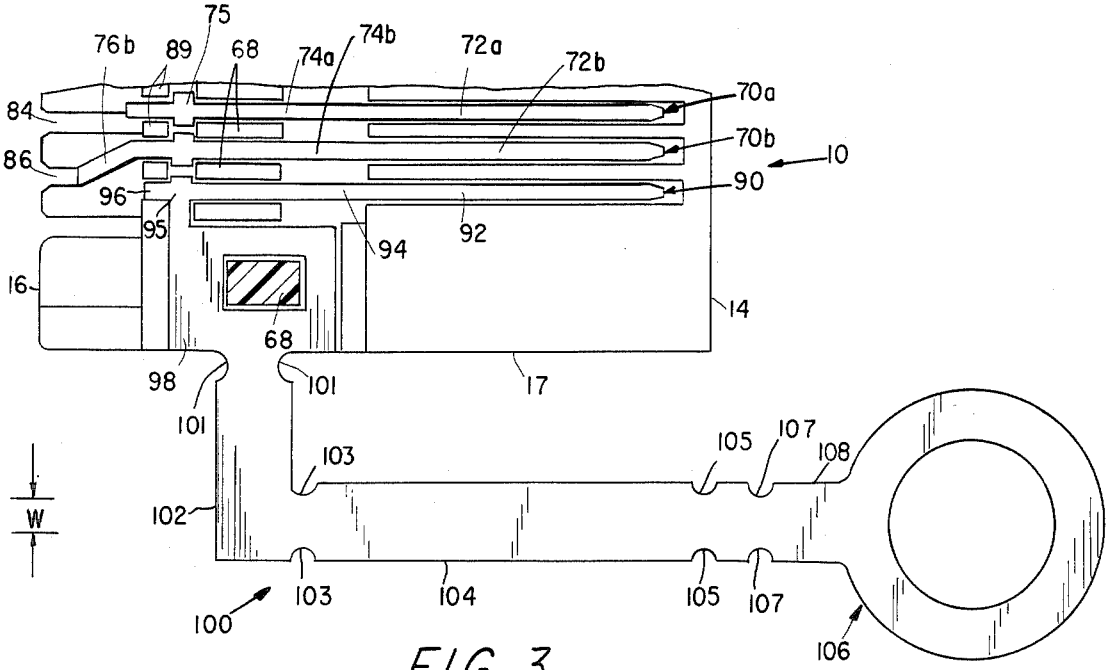
FIG. 3.
FIG. 4.
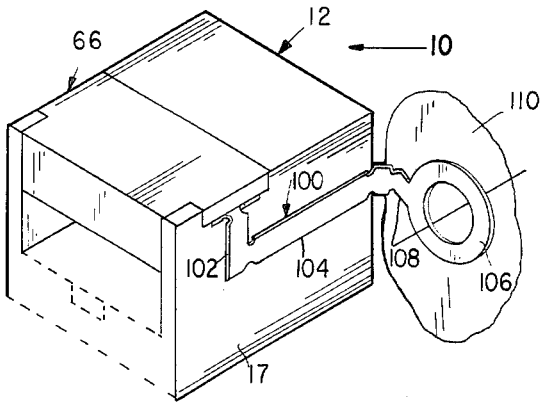

ELECTRICAL CONNECTOR WITH INTEGRAL GROUND STRAP FOR SHIELDED CABLE

This application is a continuation of application Ser. No. 841,042, filed Mar. 17, 1986, which is a continuation of application Ser. No. 761,667, filed Aug. 1, 1985, now abandoned, which is a continuation of application Ser. No. 597,279, filed 4/6/84, now abandoned.

BACKGROUND OF THE INVENTION

1. Field of the Invention

This invention relates to electrical connectors that terminate shielded cable, and more particularly is directed towards means incorporated in an electrical connector receptacle for grounding the shield of the cable.

2. Description of the Related Art

Electrical cables that incorporate one or more shielded conductors are well known. Shielded cable is used, for example, when it is desired to shield a low level, information-bearing electrical signal from spurious external electrical interference. A shield is normally provided by surrounding the information-carrying conductor with a conductive or semiconductive material that is connected in some manner to a source of ground potential.

Modular plugs and modular jacks are now widely used as general interconnect devices for a variety of types of electrical equipment. As utilized herein, the terms "modular jack" and "modular plug" connote the miniature, quick-connect-and-disconnect jacks and plugs developed by Western Electric Company and Bell Telephone Laboratories originally for use with telephone equipment (see, for example, U.S. Pat. Nos. 3,699,498; 3,850,497; and 3,860,316). The combination of a multi-conductor cable terminated by one or more modular plugs is commonly referred to as a cordset.

A modular jack generally includes a plurality of substantially identical, side-by-side conductors each of which include a spring contact portion that extends into a forwardly positioned plug-receiving cavity. The spring contact portions of the conductors make electrical contact with the upper surface of the substantially planar contact terminals of the modular plug. The plug's contact terminals characteristically include insulation-piercing tangs at their lower edges for terminating the individual wires of the multi-conductor cable.

The conductors of the modular jack generally comprise metal contacts that are stamped and formed from a thin piece of sheet metal. The width of each individual contact, which is substantially flat, may typically be about 0.0175 inch. When such a jack is utilized to directly couple a modular plug or cordset to a printed circuit board, as described, for example, in U.S. patent application Ser. No. 527,852 and in U.S. Pat. No. 4,210,376, the width of the flat metal contact is substantially constant along its length (from the spring contact portion at the plug-receiving end to the solder post portion that goes through holes formed in the printed circuit board for subsequent wave-soldering). Alternately, the spring contact portion may be crimped to an insulated wire terminated by a spade lug as set forth in U.S. Pat. No. 3,850,497.

One problem with prior art shielded cables is that, due to bulky metallic shields, they were generally too large to fit within the very limited cable-receiving cavity of a normal modular plug. In U.S. Pat. No. 4,424,403, however, a shielded multi-conductor cable is described which is particularly designed to enable termination of the cable in a miniature, telephone-type modular plug. In this patent, the shielded cable includes one or more shielded conductors which are formed by bonding an extremely thin layer of conductive material to the outer surface of an insulated wire. By maintaining an extremely thin layer of conductive material (e.g., 0.0003–0.0004 inch), the shielded conductors can fit and are capable of being terminated in a normal modular plug, resulting in a shielded cordset.

Of course, a shielded cordset requires external connection through one of the contact terminals of the modular plug to a source of ground potential. In the past, this was provided, for example, by grounding the solder post end of one of the plurality of conductors of the mating modular jack. The selected conductor positionally corresponded to the location of the required ground in the cordset.

This technique for grounding shielded cordsets suffers from several deficiencies. One deficiency arises when an EMI (electromagnetic interference) signal of high frequency is present on the shield and needs to be conducted to ground. The narrow contacts and long travel path for such high frequency signals tend to set up undesirable reflections that cause the shield to act as an antenna or radiator. This condition has created a need to find a more effective and efficient way of grounding such high frequency EMI signals.

Another problem arises with electrostatic voltage (ESV). Typically, a high frequency, high current spike is followed by a high voltage, low current spike. The narrow, low-capacity ground path for such spikes increases the possibility of their arcing into adjacent signal conductors in looking for ground. Since such adjacent conductors are normally connected to sensitive low voltage circuitry, such arcing can severely damage such circuitry and must be prevented.

It is towards overcoming these and other problems that the present invention is advanced.

SUMMARY OF THE INVENTION

The foregoing and other objects are achieved in accordance with one aspect of the present invention through the provision of an electrical jack which comprises an insulating housing having a front end, a rear end and conductor-receiving means, a plug-receiving opening extending into the front end of the insulating housing, and a plurality of electrical conductors in a side-by-side, spaced-apart relationship, each of the conductors comprising an intermediate portion extending through the conductor-receiving means, a spring contact portion extending from one end of the intermediate portion into the plug-receiving opening, and an end portion extending from the other end of the intermediate portion. The invention further comprises at least one ground conductor positioned in the housing adjacent the plurality of conductors. The ground conductor includes a ground spring contact portion extending into the opening and formed similarly to the spring contact portion of each of the other conductors. The ground conductor further includes grounding means extending outside the insulating housing and having a surface area substantially greater than that of the ground spring contact portion for coupling the ground conductor to a source of ground potential.

In accordance with other aspects of the present invention, the ground spring contact portion is substantially identical to the spring contact portion and is positioned in the housing in lateral alignment with each of the spring contact portions of the other conductors. The conductors preferably comprise stamped and formed flat contact having a first width. The ground conductor also preferably comprises a substantially flat, stamped and formed ground contact whose ground spring contact portion has a second width that is substantially identical to the first width. The grounding means of the ground conductor has a third width that is substantially greater than the second width. In a preferred embodiment, the third width is at least about twice as great as the second width. More particularly, the third width is about four to five times as great as the second width.

In accordance with another aspect of the present invention, the grounding means comprises a ground strap extending integrally from and substantially wider than the ground spring contact portion. The ground strap preferably includes terminal means formed at the free end thereof for connecting same to the source of ground potential. The terminal means may comprise either a ring terminal, a spade lug, or a solder post. In one embodiment, the ground strap includes an arm coupled to the ground spring contact portion and extending out of the housing, and a leg extending preferably at a right angle to the arm. Cutout means may be provided along the edges of the ground strap for facilitating bending thereof, and the ground strap may include a substantially rectangular portion having an opening formed therein for securing the grounding means in position within the housing.

The electrical jack of the present invention is particularly designed to receive an electrical plug of the type which terminates a multi-conductor cable having at least one shielded conductor therein. The electrical jack may be designed to mate the electrical plug directly with a printed circuit board. Alternately, the jack may terminate in insulated spade lugs, or may comprise a back-to-back female coupler. In yet another alternate embodiment, the electrical jack preferably comprises a telephone-type modular jack for receiving a telephone-type modular plug.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 2 is a cut-away sectional view similar to FIG. 1 but showing the modular plug inserted into the modular jack;

FIG. 3 is a top view showing a preferred embodiment of the present invention incorporated into the modular jack of FIG. 1;

FIG. 4 is a perspective view illustrating the embodiment of FIG. 3 in use;

DETAILED DESCRIPTION OF THE PREFERRED EMBODIMENTS

Figure 1:
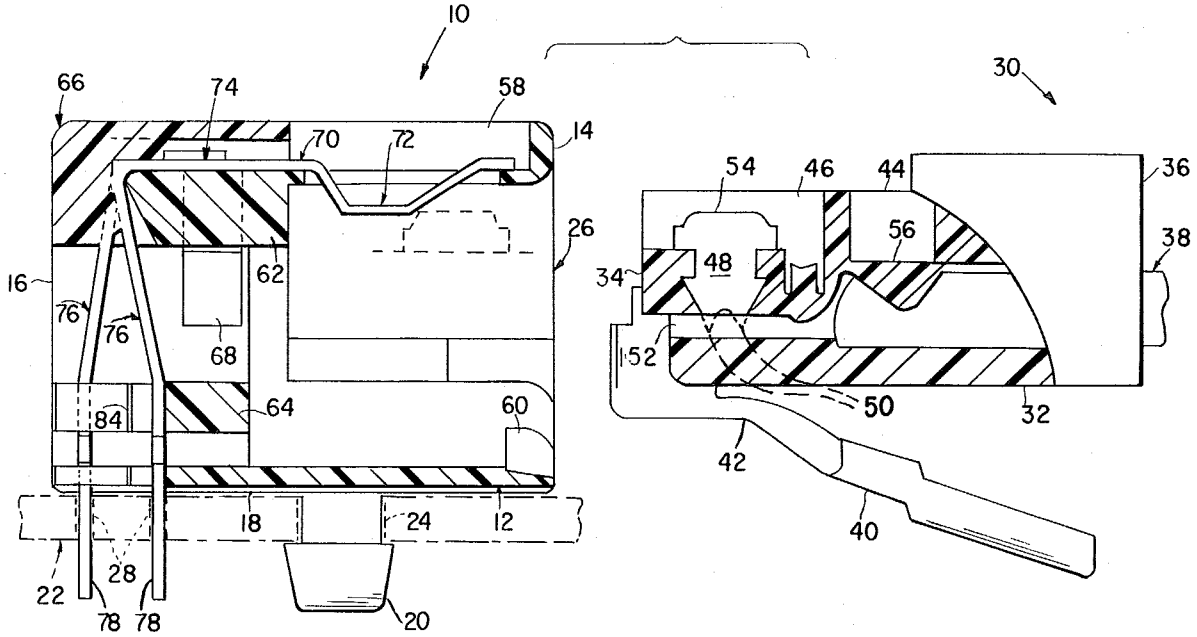
FIG. 1 is a longitudinal, side sectional view illustrating a modular jack and mating modular plug with which the present invention may be utilized.

Referring now to the drawings, wherein like reference numerals represent identical or corresponding parts throughout the several views, and more particularly to FIGS. 1 and 2 thereof, a typical electrical connector receptacle is indicated generally by reference numeral 10. Electrical connector 10 in the illustrated embodiment comprises a telephone-type modular jack as described in greater detail in prior U.S. application Ser. No. 527,852, filed Aug. 30, 1983, which is expressly incorporated herein by reference. Other modular jacks are set forth, for example, in U.S. Pat. Nos. 3,850,497 and 4,210,376, expressly incorporated herein by reference. The latter patent, as well as the '852 application, are particularly designed for directly coupling a modular plug to a printed circuit board (PCB), and whose conductors incorporate differential spacing to accommodate FCC requirements at the spring contact end (0.040 inch centerline spacing) and CAD-PCB spacing (0.050 inch) at the other end.

Although the present invention will be described and illustrated in conjunction with a telephone-type modular jack, it should be understood that the concepts thereof may be applied to other types of electrical connector receptacles.

Electrical jack 10 includes a one-piece dielectric housing 12 which generally comprises a front portion 14, a rear portion 16, a side wall 17 and a lower outer wall 18. In the illustrated PCB-mountable jack 10, a pair of mounting posts 20 extend from lower outer wall 18 for mounting the housing 12 to a PCB 22 through apertures 24 formed therein.

Located in the front portion 14 of housing 12 is a plug-receiving opening or cavity 26 which is sized to receive a mating, telephone-type modular plug indicated generally by reference numeral 30. Modular plug 30 is described in greater detail in, for example, U.S. Pat. Nos. 3,860,316; 3,954,320; and 3,998,514, all of which are incorporated herein by reference.

In general, modular plug 30 comprises a dielectric housing 32 having a free end 34 for insertion into the plug-receiving opening 26 of jack 10. Plug 30 includes a cable input end 36 having a cavity extending inside housing 32 for receiving a multi-conductor cord or cable 38. Cable 38 may comprise more particularly a cable assembly having at least one shielded conductor as described in U.S. Pat. No. 4,424,403, which is also expressly incorporated herein by reference.

Plug 30 may be further characterized by a resilient locking tab 40 connected by a flexible plastic hinge 42 to the free end 34 and extending rearwardly therefrom. Housing 32 also includes a terminal-receiving side 44 having partition walls 46 that define side-by-side slots within each of which is positioned a substantially flat, conductive contact terminal indicated generally by reference numeral 48. Contact terminal 48 is, in turn, characterized by insulation-piercing tangs 50 for making electrical contact with insulated or uninsulated wire 52 of cable 38. As stated above, wire 52 may comprise a shielded or ground conductor (as described in the '403 patent noted above). Contact terminal 48 further includes an upper surface 54 that engages the spring contact portion of the conductors of modular jack 10 in a manner to be described in greater detail hereinafter. Finally, plug 30 is characterized by the provision of a strain relief bar 56 for cable 38.

Referring back to modular jack 10, it includes a plurality of side-by-side slots 58 which extend through the upper portion of housing 12 and which open into the plug-receiving opening 26. A locking tab 60 is formed on the bottom inner wall of opening 26 for releasably receiving locking tab 40 of plug 30.

The rear portion 16 of jack 10 includes upper and lower rear partitions 62 and 64, respectively, which extend laterally from side wall to side wall of the housing. Partitions 62 and 64 internally define the rear extent of plug-receiving opening 26 and externally include means for receiving a plurality of side-by-side conductors 70 therein. Conductors 70 preferably comprise stamped and formed contacts of a predetermined width (e.g., 0.0175 inch) substantially throughout their length.

Conductors 70 each generally comprise a spring contact portion 72, an intermediate retention portion 74, a differential spacing (diverging) portion 76, and a solder post portion 78 that extends through alternating, staggered (triangular) openings 28 formed in printed circuit board 22.

The spring contact portions 72 extend into plug-receiving opening 26 and include a lower portion thereof which comes into physical and electrical contact with the upper surface 54 of contact terminal 48 upon insertion of plug 30 into jack 10, as illustrated in FIG. 2. A separate cap piece 66 is preferably used to help retain conductors 70 in housing 12. Cap 66 includes cap retaining arms 68 extending downwardly from the under surface thereof which go through apertures formed in the top of the housing 12.

As illustrated in FIGS. 1–3, the lower rear partition 64 is provided with alternating deep and shallow slots 84 and 86, respectively, to provide two substantially parallel rows of solder posts 78 in the desired alternating, staggered pattern for insertion through the PCB holes 28. The deep and shallow slot configuration is substantially duplicated in the rear portion of lower wall 18. Also, as seen best in FIG. 3, the top of housing 12 is provided with front and rear spacers 88 and 89 for defining and facilitating separation of the intermediate portions 74 of conductors 70. Conductors 70 are also preferably provided with a laterally extending tab portion 75 that fits between spacers 88 and 89 as a positioning and retention means.

As illustrated in FIG. 2, when modular plug 30 is inserted into modular jack 10, the spring contact portion 72 is flexed upwardly together with the intermediate portion 74 at a fulcrum established by protrusion 82 of cap 66. When plug 30 is fully inserted, the lower surface of spring contact portion 72 makes good contact with the upper surface 54 of contact terminal 48 of the plug.

Referring now to FIG. 3, there is illustrated a preferred embodiment of the present invention in use with the modular jack 10. In the preferred embodiment, one of the "normal" conductors 70 in jack 10 is replaced by a ground strap conductor indicated generally by reference numeral 90. As shown in FIG. 3, the conductor normally in the outermost or right-most position of jack 10 has been replaced by ground strap conductor 90.

Ground strap conductor 90 includes a spring contact portion 92 which is sized and formed substantially identically to spring contact portions 72 of conductors 70 so that it is virtually indistinguishable therefrom. Ground strap conductor 90 includes an intermediate portion 94 which is substantially identical to intermediate portions 74 of conductors 70. Thus, ground spring contact portion 92 and intermediate portions 94 function substantially the same as spring contact portions 72 and intermediate portions 74 of the remaining conductors 70 when plug 30 is inserted into plug-receiving opening 26.

However, the ground strap conductor 90 does not extend from the intermediate portion 94 downwardly over the rear partition 62 as do adjacent differentially spaced portions **76*a* and 76*b* of conductors 70*a* and 70*b*, respectively. Instead, the rearward extent of ground strap conductor 90 is limited to a terminating stub 96 designed to extend between the rear spacers 89. Formed laterally from locating portion 95 is an increased width rectangular shoulder portion 98 having a cutout in the center thereof for accommodating the retaining arm 68 of cap 66. Shoulder portion 98 also facilitates and secures positioning of the ground strap conductor 90**.

Extending integrally from shoulder portion 98 beyond outer side wall 17 of jack 10 is a ground strap indicated generally by reference numeral 100 which may take any of a number of different forms. In the first preferred embodiment illustrated in FIG. 3, ground strap 100 includes an arm 102 that extends somewhat perpendicularly from outer wall 17 and a longitudinally extending leg 104 which is formed at right angles to arm 102. Reference numeral 108 indicates an ankle transition to the terminal or foot portion 106 which may comprise either the ring terminal (as illustrated) or a spade lug, or a solder post.

In accordance with the present invention, the width of ground strap 100 is substantially greater than the width of the spring contact portion 92 thereof, the latter being of substantially the same width as that of spring contact portions 72 of the remaining conductors. More particularly, the width of the ground strap 100 is preferably at least around twice as large as that of the spring contact portion 92, and in a preferred embodiment is approximately four to five times as large. For example, the width W of ground strap 100 may be 0.080 inch, which is $4\frac{1}{2}$ times as wide as conductors 70 (0.0175 inch). In this way, there is provided a wide, large transfer surface for high frequency EMI signals to be conducted to ground, which prevents reflections and consequent re-radiating of such signals. Further, such a width provides sufficient capacity in the ground path to reduce the dielectric potential so it does not exceed the insulation strength of the insulated conductor to, in turn, prevent arcing of any electrostatic voltage spike into adjacent signal conductors.

Provided on the edges of ground strap 100 at various positions thereon are sets of cutouts, such as cutouts 101, 103, 105 and 107. These cutout sets are strategically located to provide maximum flexibility for terminating the ground strap 100, as will be seen below.

FIG. 4 illustrates the ground strap conductor 90 with ground strap 100 in use mounted on one side of jack 10. Terminal ring portion 106 is shown adjacent a metal or metal-coated front wall 110 of the cabinet in which jack 10 is mounted. Metal wall 110, it is noted, is oriented perpendicularly to the plane of side wall 17 as well as to that of the PCB 22. A screw terminal or solder may be utilized to secure ring 106 to wall 110. In this embodiment, cutouts 101, 105 and 107 are utilized to advantage, as may be readily appreciated from the drawing.

Figure 5:
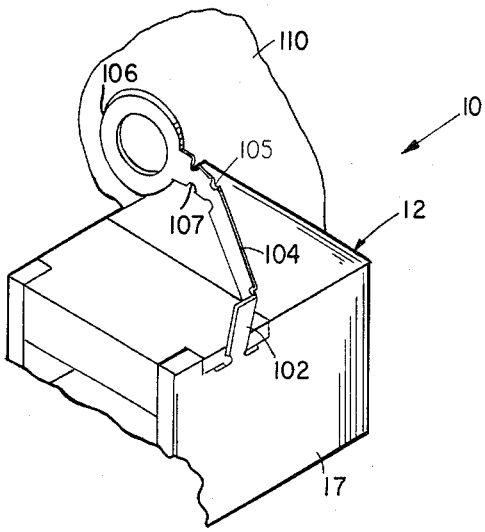
FIG. 5 is a view similar to FIG. 4 but showing an alternate manner of use of the preferred embodiment of the present invention.

FIG. 5 shows the same embodiment as FIG. 4 but the ground strap 100 of conductor 90 is bent in such a manner to secure ring terminal 106 to a portion of the front wall 110 located on top of jack housing 12. This is achieved by bending arm 102 in the opposite direction from that shown in FIG. 4, and bending leg 104 and ankle 108 in the manner illustrated.

Figure 6:
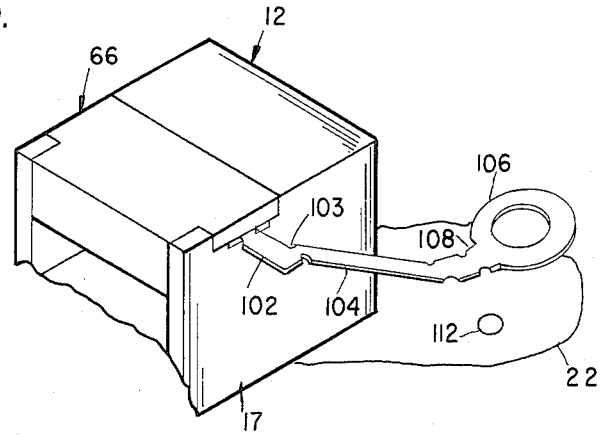
FIG. 6 is a view similar to FIGS. 4 and 5 but showing yet another alternate embodiment of the present invention in use.

FIG. 6 illustrates yet another alternate mounting arrangement wherein arm 102 in use extends perpendicularly from side wall 17, and ring terminal 106 is to be mounted onto PCB 22 for termination to a ground point located, for example, on the other side of PCB 22 through aperture 112.

Figure 7:
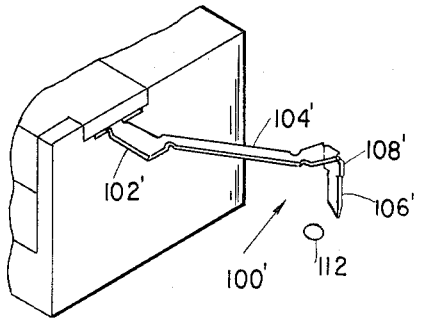
FIG. 7 illustrates a view similar to FIG. 6 but showing an alternate embodiment of the present invention.

FIG. 7 illustrates an alternate embodiment of the invention wherein ground strap 100' includes, instead of a ring terminal, a solder post 106' at the free end thereof. In this manner, solder post 106' may be inserted through aperture 112 in the PCB 22 for subsequent soldering to a source of ground potential on the opposite side.

Figure 8:
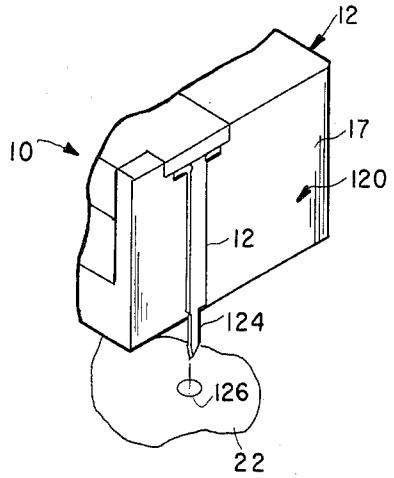
FIG. 8 illustrates yet another alternate embodiment of the present invention.

FIG. 8 illustrates a different embodiment wherein the ground strap 120 comprises a single elongated strip 122 that terminates in a tapered solder tip or post 124. An aperture 126 is positioned in PCB 22 immediately adjacent side wall 17, and post 124 is inserted through aperture 126 at the same time that the remaining solder posts 78 of conductors 70 are inserted through apertures 28 (FIG. 1). Strip 122 lies immediately adjacent wall 17, and post 124 may be wave-soldered in the same operation and at the same time as solder posts 78.

Figure 9:
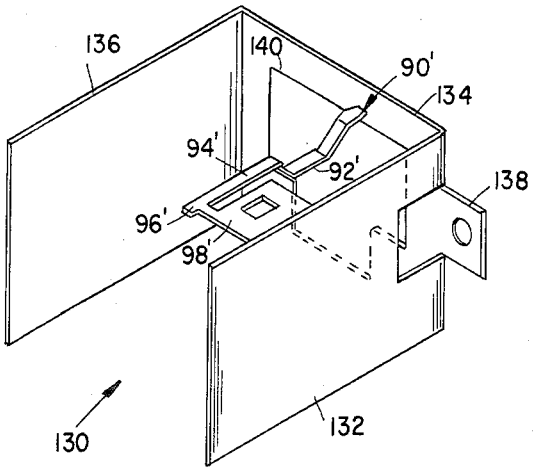
FIGS. 9 and 10 illustrate further alternate embodiments of the present invention.
Figure 10:
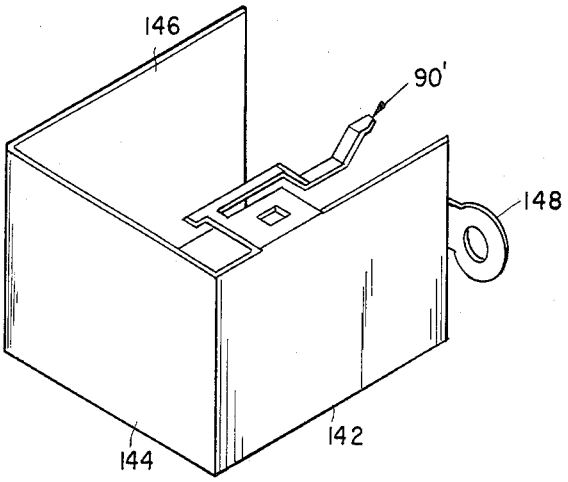

FIGS. 9 and 10 illustrate still other embodiments wherein the ground strap portion previously illustrated is replaced by a metallic connector cover indicated generally by reference numeral 130 in FIG. 9. These embodiments may be useful in situations where electrical components on the printed circuit board may be operating at very high frequencies. Since the plastic body 12 of the connector jack 10 is transparent to EMI, the metal connector cover 130 provides an effective enclosure to shield radiation from these components. In FIGS. 9 and 10, the primed numerals correspond to like unprimed numerals of the components previously described.

In FIG. 9, enclosure 130 comprises a side panel 132, a front panel 134 and an opposite side panel 136 integrally connected and extending from the ground strap conductor 90'. A tab 138 is integrally formed from the side panel 132 for securing to the metal wall of the cabinet to a source of ground potential. Further, the front panel 134 includes a cutout 140 corresponding to the necessary shape to receive the modular plug 30 therethrough. Although not illustrated, a fourth panel could be provided to cover the back of the connector housing, if desired.

FIG. 10 illustrates an embodiment which includes side panels 142 and 146 and a rear panel 144. A ring tab 148 is provided for making the ground connection. These embodiments address the problem of components on the PCB undesirably radiating through the connector housing and out through the panel enclosure.

By virtue of the present invention, there is provided a solution to high frequency EMI, and high voltage ESV spikes finding a suitable ground path in shielded modular cordsets and jacks. The present invention does not require housing modifications to the plug or jack in order to properly terminate and ground a shielded cable. In this manner, tooling costs are substantially reduced.

Numerous modifications and variations of the present invention are possible in light of the above teachings. It is therefore to be understood that, within the scope of the appended claims, the invention may be practiced otherwise than as specifically described herein.

I claim as my invention:

1. An electrical jack, which comprises:

an insulating housing having a front end, a rear end and conductor-receiving means;

a plug-receiving opening extending into said front end of said insulating housing;

a plurality of electrical conductors in side-by-side spaced-apart relationship, each of said conductors comprising an intermediate portion extending through said conductor-receiving means, a spring contact portion extending from one end of said intermediate portion into said plug-receiving opening, and an end portion extending from the other end of said intermediate portion; and at least one ground conductor positioned in said housing adjacent said plurality of conductors and including a ground spring contact portion extending into said opening and formed similarly to said spring contact portion of each of said conductors, said ground conductor including grounding means extending outside said insulating housing and having a surface area substantially greater than that of said ground spring contact portion for coupling said ground conductor to a source of ground potential; and said grounding means comprises a ground strap extending integrally from and substantially wider than said ground spring contact portion, and having a free end; and said ground strap includes terminal means formed at said free end for connecting the same to the source of ground potential; and said ground strap includes an arm coupled to said ground spring contact portion and extending out of said housing, and a leg extending angularly from said arm.

2. The jack as set forth in claim 1, wherein said ground spring contact portion is substantially identical to said spring contact portion and is positioned in said housing in lateral alignment with each of said spring contact portions of said conductors.

3. The jack as set forth in claim 1, wherein said conductors comprise stamped and formed flat contacts having a first width, and wherein said ground conductor comprises a substantially flat, stamped and formed ground contact.

4. The jack as set forth in claim 3, wherein said ground spring contact portion of said ground conductor has a second width substantially identical to said first width, and wherein said grounding means has a third width substantially greater than said second width.

5. The jack as set forth in claim 4, wherein said third width is at least about twice as great as said second width.

6. The jack as set forth in claim 4, wherein said third width is about four to five times as great as said second width.

7. The jack as set forth in claim 1, wherein said terminal means comprises a ring terminal.

8. The jack as set forth in claim 1, wherein said terminal means comprises a solder post.

9. The jack as set forth in claim 1, wherein said leg is formed at about a right angle to said arm.

10. The jack as set forth in claim 1, wherein said ground strap further comprises means formed therein for facilitating bending thereof.

11. The jack as set forth in claim 10, wherein said bending facilitating means comprises cutouts formed along the edges of said ground strap.

12. The jack as set forth in claim 1, wherein said ground strap includes means located in said housing for securing said grounding means in position.

13. The jack as set forth in claim 12, wherein said securing means comprises a substantially rectangular portion having an opening formed therein adapted to be secured by said housing.

14. A telephone-type modular jack for receiving a telephone-type modular plug, which comprises:

a housing having a front portion, a rear portion and a plurality of side-by-side conductor-receiving guide means formed therein;

an opening formed in said front portion of said housing for receiving the telephone-type modular plug, the plug having a multi-conductor cable terminated by a plurality of side-by-side, substantially planar, insulation-piercing, contact terminals positioned in the forward portion thereof, the cable including at least one shielded conductor therein;

a plurality of electrical conductors arranged in a side-by-side, spaced-apart fashion in said housing, each of said conductors including an end portion, an intermediate portion extending from said end portion through said conductor-receiving guide means, and a spring contact portion extending from said intermediate portion into said opening;

at least one ground conductor positioned in said housing adjacent said plurality of conductors and including a ground spring contact portion extending into said opening and formed similarly to said spring contact portion of each of said conductors, said ground conductor including grounding means extending outside said housing and having a surface area substantially greater than that of said ground spring contact portion for coupling said ground conductor to a source of ground potential; and said grounding means comprises a ground strap extending integrally from and substantially wider than said ground spring contact portion, and having a free end; and said ground strap includes terminal means formed at said free end for connecting the same to the source of ground potential; and said ground strap includes an arm coupled to said ground spring contact portion and extending out of said housing, and a leg extending angularly from said arm; and said contact terminals of said telephone-type modular plug engaging said spring contact portions of said conductors and said ground spring contact of said ground conductor after insertion of said telephone-type modular plug into said opening of said telephone-type modular jack.

15. The jack as set forth in claim 14, wherein said ground spring contact portion is substantially identical to said spring contact portion and is positioned in said housing in lateral alignment with each of said spring contact portions of said conductors.

16. The jack as set forth in claim 14, wherein said conductors comprise stamped and formed flat contacts having a first width, and wherein said ground conductor comprises a substantially flat, stamped and formed ground contact.

17. The jack as set forth in claim 16, wherein said ground spring contact portion of said ground conductor has a second width substantially identical to said first width, and wherein said grounding means has a third width substantially greater than said second width.

18. The jack as set forth in claim 17, wherein said third width is at least about twice as great as said second width.

19. The jack as set forth in claim 17 wherein said third width is about four to five times as great as said second width.

20. The jack as set forth in claim 14, wherein said terminal means comprises a ring terminal.

21. The jack as set forth in claim 14, wherein said terminal means comprises a solder post.

22. The jack as set forth in claim 14, wherein said leg is formed at about a right angle to said arm.

23. The jack as set forth in claim 14, wherein said ground strap further comprises means formed therein for facilitating bending thereof.

24. The jack as set forth in claim 23, wherein said bending facilitating means comprises cutouts formed along the edges of said ground strap.

25. The jack as set forth in claim 14, wherein said ground strap includes means located in said housing for securing said grounding means in position.

26. The jack as set forth in claim 25, wherein said securing means comprises a substantially rectangular portion having an opening formed therein adapted to be secured by said housing.

* * * * *